US008276320B2

(12) United States Patent
Erbrect et al.

(10) Patent No.: US 8,276,320 B2
(45) Date of Patent: Oct. 2, 2012

(54) METHOD OF AND SYSTEM FOR SEALING AN ENTRY

(75) Inventors: Kelly Erbrect, Schofield, WI (US); Stan Nowak, Mosinee, WI (US); Pete Strycharske, Wausau, WI (US)

(73) Assignee: Oldcastle BuildingEnvelope, Inc., Plano, TX (US)

( * ) Notice: Subject to any disclaimer, the term of this patent is extended or adjusted under 35 U.S.C. 154(b) by 742 days.

(21) Appl. No.: 12/181,856

(22) Filed: Jul. 29, 2008

(65) Prior Publication Data

US 2009/0038231 A1 Feb. 12, 2009

Related U.S. Application Data

(60) Provisional application No. 60/962,494, filed on Jul. 30, 2007.

(51) Int. Cl.
*E06B 1/70* (2006.01)

(52) U.S. Cl. ..... 49/471; 49/476.1; 49/504

(58) Field of Classification Search ..... 49/467, 49/469, 470, 501, 504, 484.1, 408, 476.1, 49/471; 52/209
See application file for complete search history.

(56) References Cited

U.S. PATENT DOCUMENTS 3,384,996 A 5/1968 Gilchrist et al.
3,961,452 A 6/1976 Hubbard et al.
4,006,573 A 2/1977 Biebuyck
4,008,552 A 2/1977 Biebuyck
4,010,671 A 3/1977 Hubbard et al.
4,030,260 A 6/1977 Sukolics et al.
4,050,201 A 9/1977 Hubbard et al.
4,055,917 A 11/1977 Coller
4,055,923 A 11/1977 Biebuyck
4,119,336 A 10/1978 Sparrevohn
4,194,776 A 3/1980 Biebuyck
4,203,255 A 5/1980 Naslund et al.
4,344,254 A * 8/1982 Varlonga ..... 49/401
4,405,165 A 9/1983 Johns
4,478,444 A 10/1984 Kurz et al.
4,553,361 A * 11/1985 Ralph ..... 52/209
4,644,717 A 2/1987 Biebuyck
4,658,544 A 4/1987 McCarty
4,739,561 A 4/1988 Mills
4,748,771 A 6/1988 Lehnert et al.
4,773,193 A 9/1988 Biebuyck et al.
4,891,921 A 1/1990 Governale
4,899,508 A 2/1990 Biebuyck
4,955,521 A 9/1990 Michael (Continued)

OTHER PUBLICATIONS

U.S. Appl. No. 09/564,349, Biebuyck.

(Continued)

*Primary Examiner* — Katherine W Mitchell
*Assistant Examiner* — Catherine A Kelly
(74) *Attorney, Agent, or Firm* — Winstead PC

(57) ABSTRACT

A system for impeding air or liquid penetration through an entry into the interior of a structure includes a door mounted to a door frame. The door frame includes at least one integral cavity. The system also includes a dual-sealing system between the door and the door frame. The dual-sealing system includes an inner seal and an outer seal. A drainage cavity is defined by a region bounded by the inner seal, the outer seal, the door, and the door frame. A gap is formed in the outer seal that permits equalization of pressure of the cavity with external atmospheric pressure.

26 Claims, 6 Drawing Sheets

U.S. PATENT DOCUMENTS

| | | | | |
|---|---|---|---|---|
| 5,036,637 | A | | 8/1991 | Biebuyck |
| 5,046,285 | A | | 9/1991 | Fratini, Jr. et al. |
| 5,056,263 | A | | 10/1991 | Bies |
| 5,058,344 | A | | 10/1991 | Biebuyck |
| 5,061,022 | A | | 10/1991 | Meriwether |
| 5,069,358 | A | | 12/1991 | Avery, Jr. |
| 5,088,780 | A | | 2/1992 | Doherty |
| 5,107,622 | A | | 4/1992 | Fuchs et al. |
| 5,117,587 | A | | 6/1992 | Doan |
| 5,123,874 | A | | 6/1992 | White, III |
| 5,125,196 | A | | 6/1992 | Moody |
| 5,150,544 | A | | 9/1992 | Burnett |
| RE34,184 | E | | 2/1993 | Baird et al. |
| 5,186,698 | A | | 2/1993 | Mason et al. |
| 5,192,398 | A | | 3/1993 | Kress et al. |
| 5,197,225 | A | | 3/1993 | Yff |
| 5,238,539 | A | | 8/1993 | Baird |
| 5,241,132 | A | | 8/1993 | McCormack |
| 5,319,882 | A | | 6/1994 | Biebuyck |
| 5,325,279 | A | | 6/1994 | Freelove et al. |
| 5,345,733 | A | | 9/1994 | Brockman et al. |
| 5,350,262 | A | | 9/1994 | Michaelis et al. |
| 5,352,174 | A | | 10/1994 | Mason et al. |
| 5,437,130 | A | | 8/1995 | Raynak |
| 5,454,192 | A | | 10/1995 | Adler et al. |
| 5,469,665 | A | | 11/1995 | Biebuyck |
| 5,480,199 | A | | 1/1996 | Husting |
| 5,522,180 | A | | 6/1996 | Adler et al. |
| 5,528,865 | A | | 6/1996 | Johnson et al. |
| 5,543,767 | A | | 8/1996 | Elenbaas |
| 5,553,419 | A | | 9/1996 | Jenkins, II |
| 5,556,515 | A | | 9/1996 | Giunta et al. |
| 5,577,349 | A | | 11/1996 | Rissone |
| 5,603,810 | A | | 2/1997 | Michler |
| 5,634,303 | A | | 6/1997 | Ellingson |
| 5,638,639 | A | | 6/1997 | Goodman et al. |
| 5,658,434 | A | | 8/1997 | Schlosser |
| 5,670,025 | A | | 9/1997 | Baird |
| 5,704,095 | A | | 1/1998 | Guenschel |
| 5,706,607 | A | * | 1/1998 | Frey ..... 49/478.1 |
| 5,720,855 | A | | 2/1998 | Baird |
| 5,785,323 | A | | 7/1998 | Heinzen |
| 5,791,113 | A | | 8/1998 | Glowa et al. |
| 5,836,118 | A | | 11/1998 | Thornton et al. |
| 5,836,424 | A | | 11/1998 | Allen |
| 5,875,660 | A | | 3/1999 | Olshausen |
| 5,901,510 | A | | 5/1999 | Ellingson |
| 5,930,955 | A | | 8/1999 | Biebuyck |
| 5,943,825 | A | * | 8/1999 | Procton et al. ..... 49/469 |
| 6,012,257 | A | | 1/2000 | Caplette |
| 6,033,247 | A | | 3/2000 | Gregory, II |
| 6,058,655 | A | | 5/2000 | Gravel |
| 6,098,355 | A | * | 8/2000 | Li ..... 52/212 |
| 6,116,615 | A | | 9/2000 | Trehan |
| 6,134,854 | A | | 10/2000 | Stanchfield |
| 6,170,210 | B1 | | 1/2001 | Marts |
| 6,219,971 | B1 | | 4/2001 | Headrick |
| 6,250,016 | B1 | | 6/2001 | Gravel |
| 6,266,933 | B1 | | 7/2001 | Park |
| 6,311,435 | B1 | | 11/2001 | Brockman et al. |
| 6,381,905 | B1 | | 5/2002 | Rissone |
| 6,494,064 | B1 | | 12/2002 | Pena |
| 6,637,158 | B2 | * | 10/2003 | Bennett ..... 49/504 |
| 6,652,114 | B2 | | 11/2003 | Ancel |
| 6,658,696 | B2 | | 12/2003 | Buckelew |
| 6,826,877 | B1 | | 12/2004 | Stradel |
| 6,916,406 | B2 | | 7/2005 | Baird |
| 6,976,716 | B2 | | 12/2005 | Lin |
| 7,101,064 | B2 | | 9/2006 | Ancel |
| 7,140,154 | B2 | | 11/2006 | Governale et al. |
| 7,275,352 | B2 | | 10/2007 | Autovino et al. |
| 2002/0112420 | A1 | * | 8/2002 | Phomphakdy et al. ..... 52/204.1 |

OTHER PUBLICATIONS

Thermal Windows Inc, Series "1401" OS Terrace Door, Engineering drawings, 1 page dated Oct. 20, 2003.

Zero International, Engineering Drawings, (7 pages) Undated.

Vistawall Architectural Products, Standard Door Frames-Engineering Drawings, Oct. 1986 (2 pages).

Traco, Heavy Commercial Terrace Door—Engineering Drawings—(2 pages) undated.

Walker, Rich, Industry Watch: "Door Standards and Certification Strive to Address Real-World Conditions", National Glass Association, Aug. 2007, (2 pages).

Lewis, Dean, "Fine-Tuning Door Certification". Door & Window Manufacturer Magazine, vol. 7, Issue 11, Key Communications Inc., Dec. 2006 (2 pages).

* cited by examiner

METHOD OF AND SYSTEM FOR SEALING AN ENTRY

CROSS-REFERENCE TO RELATED APPLICATIONS

This patent application claims priority from, and incorporates by reference the entire disclosure of, U.S. Provisional Patent Application No. 60/962,494, filed on Jul. 30, 2007.

BACKGROUND

1. Technical Field

The present invention pertains to sealing an entry to a structure to prevent intrusion of the elements (e.g., air and water) and, more particularly, but not by way of limitation, to a door and low profile door jamb sealing assembly that addresses both sealing of a space around the door from the passage of air and moisture and pressure equalization relative to outside air forces.

2. History of Related Art

The use of doors and door-frame assemblies in both residential and commercial buildings is a well-known, integral part of conventional building construction. It is also an area which must meet certain design and size limitations in order to allow disabled individuals to pass therethrough. The doors which permit passage or entry into a building from a space outside of the building are typically mounted within a door frame. Door-frame assemblies typically include a horizontal lower plate, also called a threshold or sill, a header, and two vertical members comprising the jamb. When closed, the door typically abuts against a door jamb stop on the vertical door jamb members and the header of the door-frame assembly. In its closed position within the vertical door jamb, the door is also positioned above a substantial portion of the sill member.

The combination of the header, vertical door jamb, and sill works together to perform multiple functions. The door-frame assembly provides structural support for, and surfaces for the pivotal swinging and sealing of, the door mounted thereto. A door-frame sill can raise the surface over which the door swings. A raised surface of the door-frame sill is designed to form a barrier to water infiltration beneath the door. In essence, it forms a dam which should hold back water infiltration. The header, vertical door jambs, and door-frame sill then function together to form a complete seal around the door which is designed to limit the infiltration of both air and moisture.

Prior-art door sealing systems have incorporated a variety of door-frame sill designs. Common styles of prior-art door-frame sills include elongated members which are formed into a variety of different shapes and sizes. These prior-art door-frame sills are typically adapted for positioning beneath swinging doors. Prior-alt door-frame sill designs generally include a first portion adapted for facing toward an interior of the building and a second portion facing outwardly toward an exterior of the building. The outwardly facing portion of the door-frame sill is generally designed to be a barrier to the passage of water beneath the door.

Door frames typically provide a requisite mounting for a door and surround the door's perimeter when the door is closed therein. Door frames are generally made of either wood or metal. Design parameters for door frames typically include width, length, cross-sectional shape, manner of securement to the surrounding building wall, and the manner of sealing three sides of the door with the jamb and header. The door-frame sill underlies the fourth, bottom side of the door, as referenced above.

To date, there have been various prior-art door sealing systems which have both advanced and improved the effectiveness of sealing a space around the edges of a door against the passage of air or moisture. One example of a prior-art door sealing system appears in U.S. Pat. No. 5,468,665. These prior-art door sealing systems often include gaskets and flanges which can be secured to the bottom of the door and/or to the door frame. While prior-art door sealing systems may be effective for some applications, it has been found that door assemblies used in buildings located in a high wind area, such as, for example, near the ocean, present even more difficult sealing problems.

To prevent the elements from penetrating the gap between the bottom of the door and the upper surface of the door-frame sill, a portion of the door-frame sill is usually raised above the level of the exterior landing approaching the door-frame sill, and raised above the structure's interior floor level. It is the rise of this door-frame sill that often causes the entry difficulties addressed by the Americans with Disabilities Act ("ADA"). The Fair Housing Amendments Act of 1988, P.L. 100-430, 102 Stat. 1619, amended the Fair Housing Act of 1968 to extend its coverage to housing discrimination on the basis of handicap. The core of the amended statute's provisions relating to housing discrimination on the basis of handicap appears in Section 804(f), codified at 42 U.S.C. §3604(f), which includes a subsection 3604(f)(3)(B), making it unlawful to refuse to make reasonable accommodations to afford a handicapped person equal opportunity to use and enjoy a dwelling.

Many prior-art door-frame sills are made of wood or metal. A primary consideration in the design of these prior-art door-frame sills is the ability to allow passage and withstand repeated exposure to inclement weather, particularly blowing wind and water. Metal door-frame sills, as opposed to wood door-frame sills, are generally better suited for resisting prolonged exposure to moisture. Some prior-art metal door-frame sills are formed with a hollow space beneath them to reduce cost and overall weight. Design parameters for door-frame sills typically include, for example, length, width, and cross-sectional shape. Because of the guidelines in the ADA and Fair Housing Act, door-frame sills in buildings are required to have a sufficiently low profile to provide easy access for passage of individuals in wheelchairs and individuals using walkers, crutches, or canes.

Specifically, many prior-art door sealing systems are rendered ineffective by high winds. Also, various prior-art door-sealing systems fail to effectively seal the door against high winds and moisture at a point where the door and the door-frame sill come together. This is particularly true with door-frame sill heights as required by ADA regulations and the like. The Fair Housing Act Design Manual at page 4.12 recommends that builders use a solution other than raising the level of the door-frame sill to prevent penetration of the elements.

It would be advantageous to provide a door sealing system including a door-frame sill that provides an improved system for preventing moisture and air infiltration, particularly in environments where high winds blow moisture against the outside surface of the door, and which further facilitates drainage of any water infiltrated into internal areas of the door-frame sill to prevent subsequent infiltration into the building.

SUMMARY OF THE INVENTION

A system for impeding air or liquid penetration through an entry into the interior of a structure includes a door mounted to a door frame. The door frame includes at least one integral cavity. The system also includes a dual-sealing system between the door and the door frame. The dual-sealing system includes an inner seal and an outer seal. A drainage cavity is defined by a region bounded by the inner seal, the outer seal, the door, and the door frame. A gap is formed in the outer seal that permits equalization of pressure of the cavity with external atmospheric pressure.

A method of impeding infiltration of air or liquid through a structure entry includes providing a door mounted to a door frame comprising a door-frame cavity and an inner seal and an outer seal. A drainage cavity is defined by a region bounded by the inner seal, the outer seal, the door, and the door frame. The method also includes equalizing drainage-cavity pressure with external atmospheric pressure via at least one gap formed in the outer seal and draining liquid from the door-frame cavity via at least one weep hole formed in the door frame and interoperably coupled with the door-frame cavity.

A wheelchair-accessible structure-entry method includes mounting a gooseneck gasket to a threshold member of a door frame. The method includes, responsive to a door-flame-mounted door applying contact pressure against an upwardly extending J-shaped portion of the gooseneck gasket, the gooseneck gasket folding and forming a compression seal against the door-frame-mounted door. The method is further includes, responsive to a wheel applying rolling pressure to the gooseneck gasket, the gooseneck gasket deforming to permit the wheel to roll over the threshold member.

BRIEF DESCRIPTION OF THE DRAWINGS

For a more complete understanding of the door sealing system of the present invention and in furtherance of the objects and advantages thereof, reference may now be had to the following description taken in conjunction with the accompanying drawings in which.

DETAILED DESCRIPTION OF ILLUSTRATIVE EMBODIMENTS OF THE INVENTION

Figure 1:
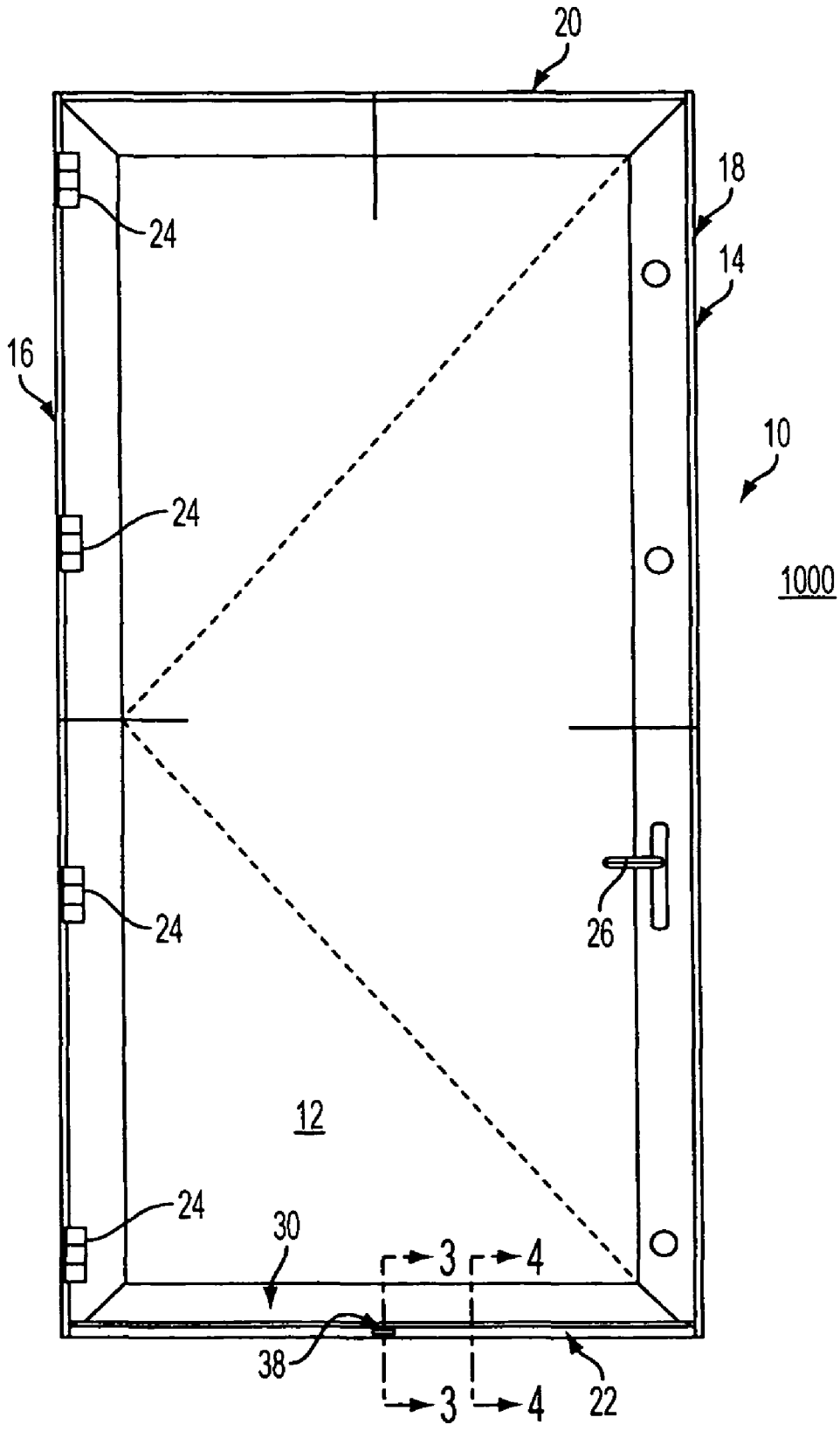
FIG. 1 illustrates a front plan view of a door and door-frame assembly.

Various embodiments of the invention will now be described more fully with reference to the accompanying drawings. The invention may, however, be embodied in many different forms and should not be constructed as limited to the embodiments set forth herein; rather, the embodiments are provided so that this disclosure will be thorough and complete, and will fully convey the scope of the invention to those skilled in the art. Wherever possible, the same reference numerals are used throughout the drawings to refer to the same or similar parts.

Referring first to FIG. 1, there is shown a door-sealing system 10 adapted for mounting in a commercial or residential building 1000 to provide a barrier against air or water infiltration into the building 1000 while also providing acceptable access thereacross and into the building 1000. The door-sealing system 10 includes a door panel 12 mounted in a door sash 30 and a door-frame assembly 14 to which the door sash 30 is pivotally mounted for opening and closing relative thereto and sealing therewith to prevent infiltration of moisture and air into the building 1000. The door-frame assembly 14, which may be also referred to as the door jamb, includes a door-hinge-side vertical iamb member 16, a door-latch-side vertical iamb member 18, disposed in generally parallel spaced relationship therefrom and connected by an upper header 20 and a lower threshold, or door-frame sill 22. A plurality of hinges 24 are adapted to connect the door sash 30 to the door-frame assembly 14 as shown herein. The plurality of hinges are further adapted to facilitate a hinge connection between the door sash 30 and the door-frame assembly 14 once a handle 26 allows the door sash 30 to be unlocked from the door-frame assembly 14 for pivotal movement therefrom. In a typical embodiment, one or more of the plurality of hinges 24 are not sealed to connection surfaces to the door-frame assembly 14 so as to allow passage of air and water therethrough.

Figure 2:
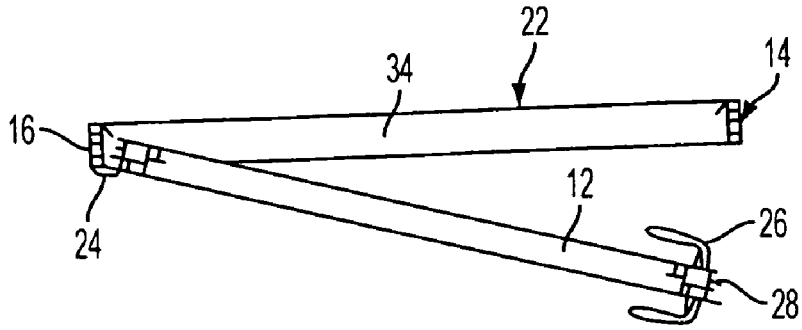
FIG. 2 illustrates a plan view of the door and door-frame assembly of FIG. 1 with the door illustrated in a position swinging outwardly from the door-frame assembly.

Referring now to FIG. 2, the outwardly pivotal movement of the door sash 30 relative to the door-frame assembly 14 is shown in a top-plan view. A handle 26 has an actuation mechanism 28 allowing interlocking of the door sash 30 with the door-frame assembly 14. Likewise, the hinges 24 pivotally connect the door sash 30 to the door-hinge-side vertical jamb member 16 for pivotal support therefrom. In this view, an upper surface 34 of the door-frame sill 22 is diagrammatically shown.

Figure 3:
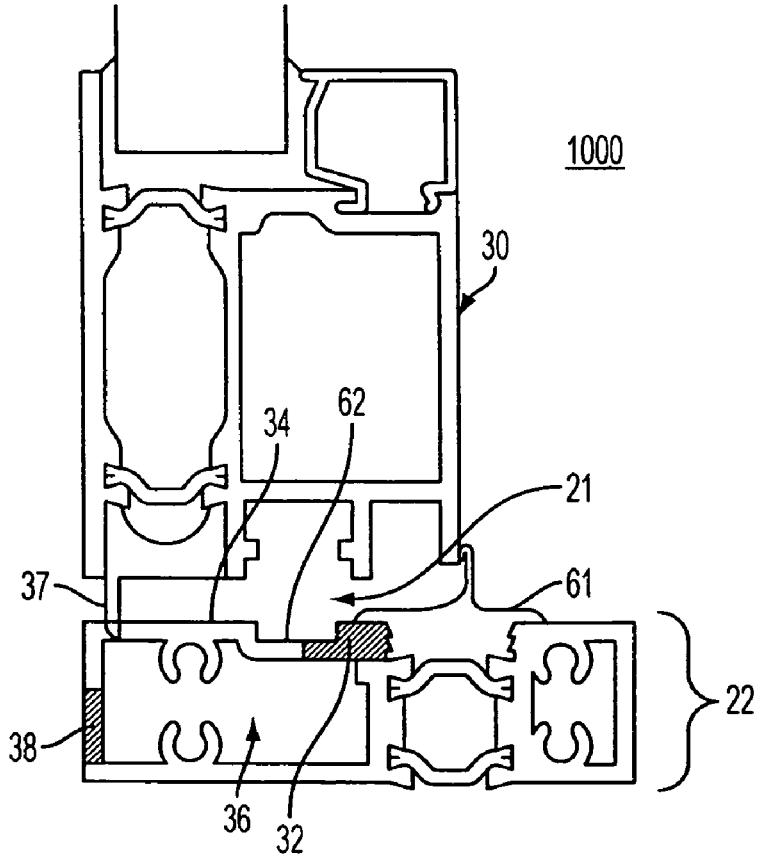
FIG. 3 illustrates an enlarged, side elevational, cross-sectional view of the extruded metal fabrication of the lower region of the door-frame assembly and the threshold taken along the lines 3-3 of FIG. 1.
Figure 4:
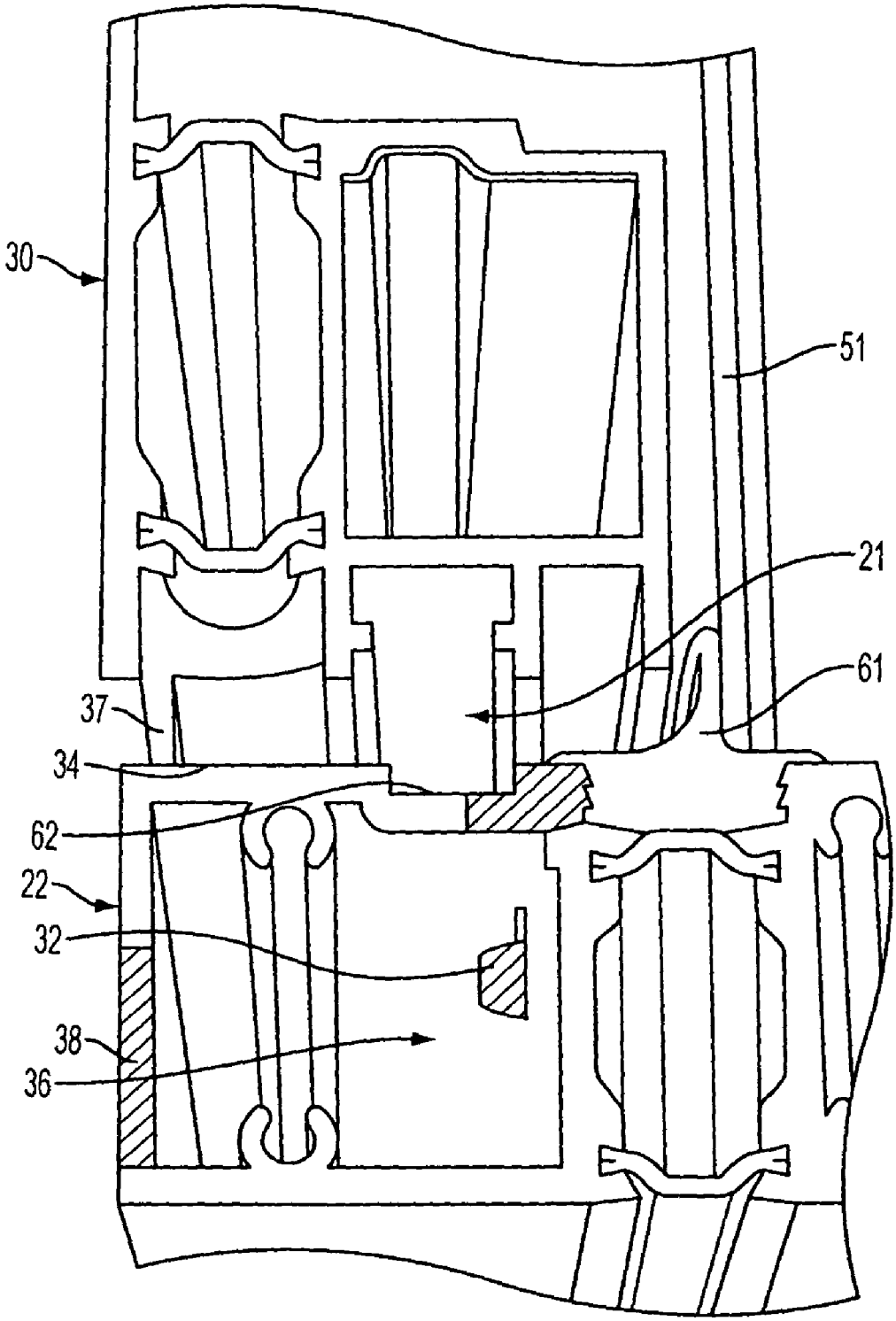
FIG. 4 illustrates an enlarged cross-sectional perspective, side view of the extruded metal fabrication of the lower region of the door-frame assembly and the threshold taken along the lines 4-4 of FIG. 1.

Referring now to FIGS. 3 and 4 together, there are shown enlarged, cross-sectional views of the door sash 30 incorporating a door-bottom gasket 37 to effect a sealed relationship with the upper surface 34 of the door-frame sill 22. The upper surface 34 of the door-frame sill 22 has a groove 62. Extending vertically upward from the upper surface 34 of the door-frame sill 22 at the interior side of the groove 62 of the upper surface 34 is a rubber seal 61. In a typical embodiment, the rubber seal 61 has an upwardly extending generally J-shaped portion as shown. A dual-sealed cavity 21 is formed when the door is closed. The dual-sealed cavity 21 is enclosed by the upper surface 34 of the door-frame sill 22, the door-bottom gasket 37, the door sash 30, and the rubber seal 61. The groove 62 of the upper surface 34 of the door-frame sill 22 serves as a canal in the dual-sealed cavity 21 to channel water to a drainage weep slot 32. The drainage weep slot 32 is located along the interior side of the groove 62. The drainage weep slot 32 opens into an interior cavity 36 formed within the extruded sides of the door-frame sill 22. A separate external weep hole 38 is likewise shown formed at the bottom of the interior cavity 36 in the external side of the door-frame sill 22. The external weep hole 38 allows water discharge from the interior cavity 36. The external weep hole 38 may be placed in any appropriate location along the span of the door-frame sill 22. By way of example, the external weep hole 38 is shown in FIG. 3 as being in line with the drainage weep slot 32 so that the external weep hole 38 and the drainage weep slot 32 are disposed at the same linear position on the span of the door-frame sill 22.

Figure 5:
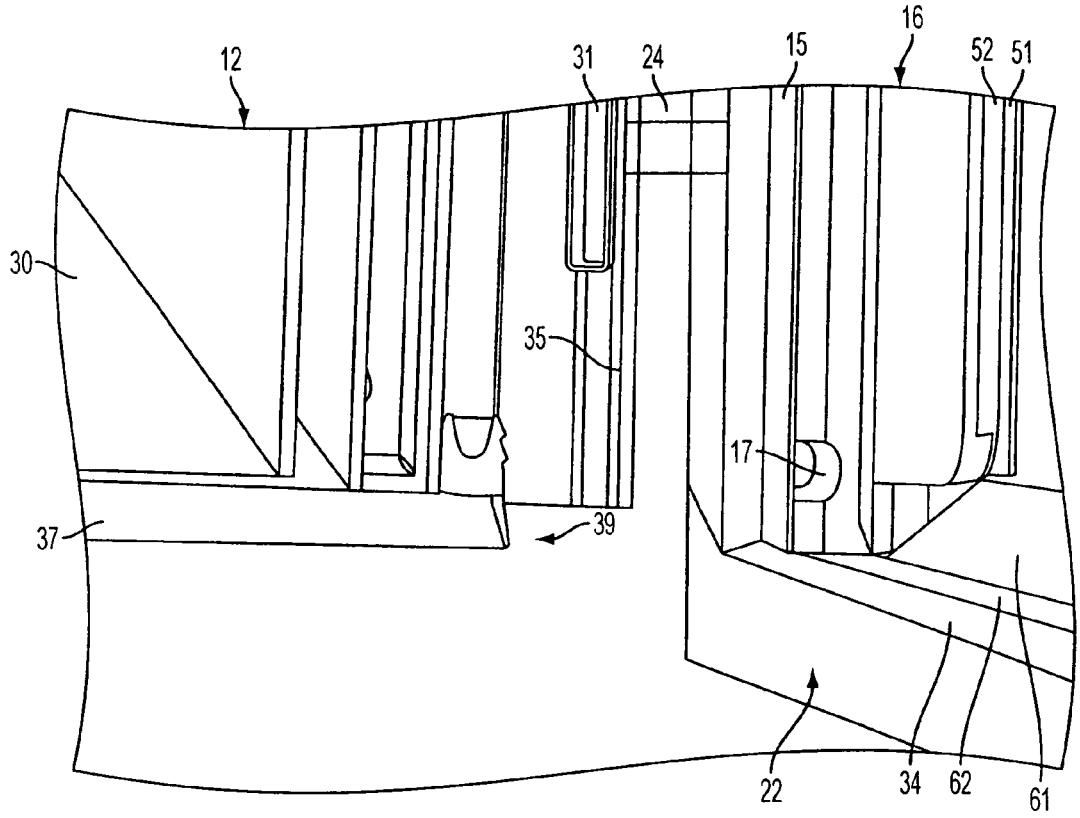
FIG. 5 illustrates a partial front plan view of the door-frame assembly with the door opened.

Referring now to FIG. 5, a lower corner of the door-frame assembly 14 with the door sash 30 in an open position is shown. A door jamb stop 51 extends out from the door-hinge-side vertical jamb member 16 along the full length of the door-hinge-side vertical jamb member 16. A door jamb stop gasket 52 is disposed along the full vertical length of the door jamb-stop 51. The width of the door sash 30 is shown; the exterior side of the door sash 30 extends to a greater width than the interior side of the door sash 30. A similar extension of the exterior side of the door sash 30 exists along the height of the top horizontal member (not shown in FIG. 5) of the door sash 30. The narrower interior side of the door sash 30 forms a seal with the door jamb stop gasket 52 when the door sash 30 is closed. A gasket 31 is disposed along the interior side of the wider exterior portion of the door sash 30. The gasket 31 forms a seal along the exterior of the hinge-side 15 of the door-hinge-side vertical door jamb member 16 when the door sash 30 is closed. Thus, when the door is closed, a hinge cavity is formed by the interior side of the wider portion of the door sash 30, the door jamb, the door jamb stop, and the hinge-side width of the extruded door sash 30. The bottom of the hinge cavity joins and is continuous with the interior cavity 36 formed above the door-frame sill 22 as shown in FIG. 4. Thus, any liquids that might pass beyond the first seal formed by the gasket 31 drain down the hinge cavity onto the upper surface 34 of the door-frame sill 22 to further drain to the structure exterior therefrom. But, as shown in FIG. 5, the gasket 31 does not extend fully to the lowest vertical height of the door sash 30. As a result, a gap 35 is left at the lowest vertical height of the door sash 30 between the door-hinge-side vertical jamb member 16 and the door sash 30. The gap 35 allows air-pressure equalization between the hinge cavity and air pressure outside the door sash 30, thus preventing air-pressure-induced flow of liquids beyond the seal formed by gasket 31. Similarly formed and continuously connected cavities (not shown in any Figures) are formed between the door sash 30 and the door-latch-side vertical jamb member 18 and between the door sash 30 and the upper header 20.

Still referring to FIG. 5, the door-bottom gasket 37 is disposed along a portion of the bottom edge of the door sash 30. Similar to the gasket 31 above, the door-bottom gasket 37 does not extend the entire horizontal length of the door sash 30, leaving a gap 39 between the door sash 30 and the upper surface 34 of the door-frame sill 22 at the bottom edge of the door sash 30 closest to the door-hinge-side vertical jamb member 16. The gap 35 and the gap 39 allow passage of air from outside the door sash 30 into the dual-sealed cavity 21 (shown in FIG. 4), thereby functioning to equalize the pressure between air flow outside and against the door-frame assembly 14 and the dual-sealed cavity 21. The gap 39 under at least some circumstances also facilitates weeping of water to the exterior of the door sash 30. During operation, water entering the dual-sealed cavity 21 via the gap 35 and the gap 39 drains into the interior cavity 36 of the door-frame sill 22 via the drainage weep slot 32 (shown in FIGS. 3 and 4). The water then drains from the interior cavity 36 via the external weep hole 38 (shown in FIG. 3). The door-hinge-side vertical jamb member 16 also has a weep hole 17 at the bottom that allows water drainage from the door-hinge-side vertical jamb member 16 into the dual-sealed cavity 21. In some cases, water exiting the weep hole 17 may in some cases flow to outside the door sash 30 via the gap 39.

Figure 6:
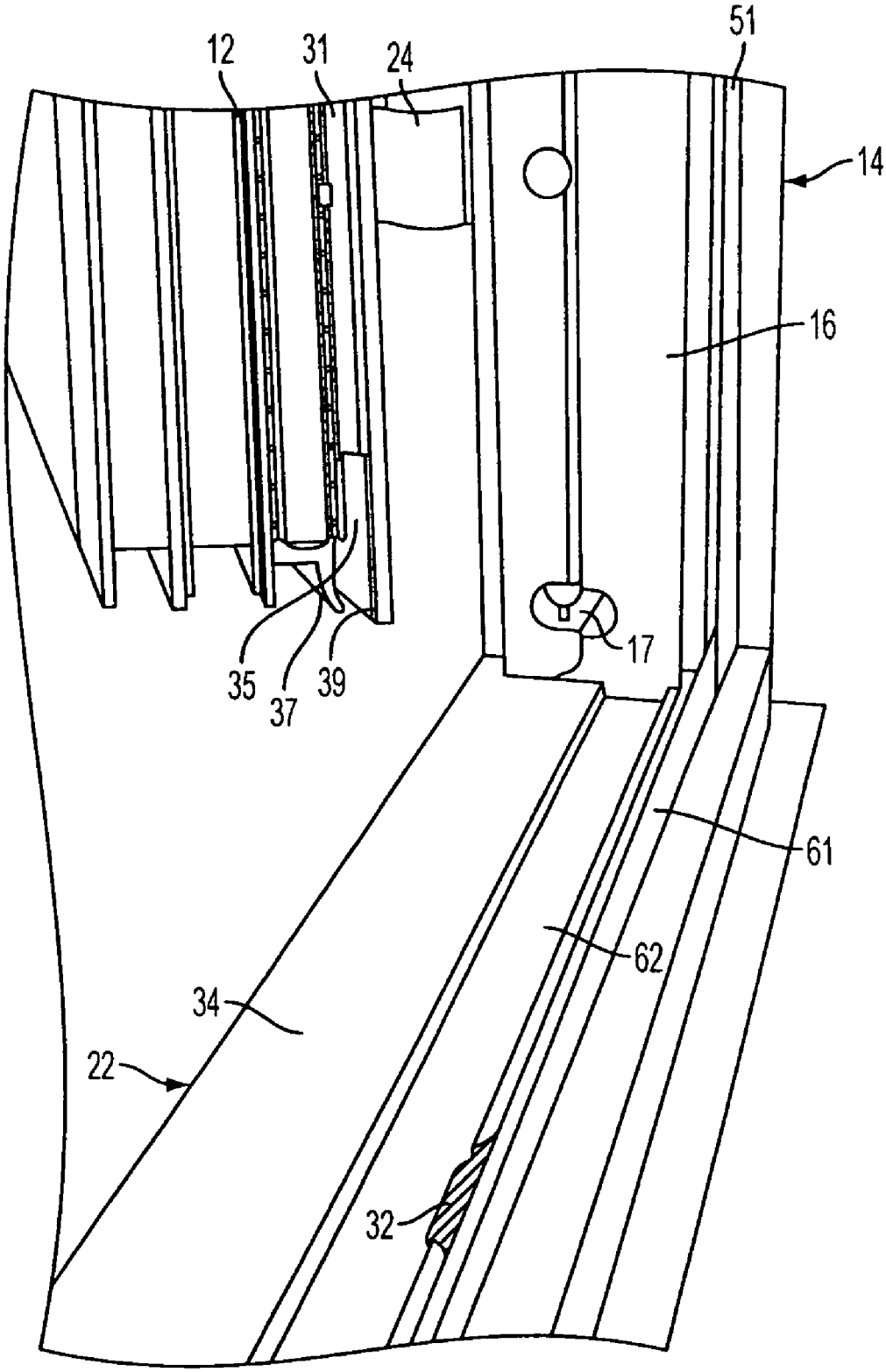
FIG. 6 illustrates an end perspective, interior view of the door-frame assembly of FIG. 5 with the door partially closed from its position in FIG. 5.

Referring now to FIG. 6, a lower corner of the door-frame assembly 14 on the door-hinge-side vertical jamb member 16 with the door sash 30 in an open position is shown. From this view, the drainage weep slot 32 and the weep hole 17 are visible. The drainage weep slot 32 is in the upper surface 34 of the door-frame sill 22, and the weep hole 17 is in a side portion of the door-hinge-side vertical jamb member 16. The weep hole 17, the drainage weep slot 32, and the external weep hole 38 (shown in FIG. 3) facilitate water discharge from the area of the dual-sealed cavity 21, while the gap 35 and the gap 39 help provide air-pressure equalization between the dual-sealed cavity 21 and outside air pressure, thus preventing pressure-induced flow of any liquid beyond the seal formed by the door-bottom gasket 37. As noted above, the gap 39 may also facilitate weeping.

Figure 7:
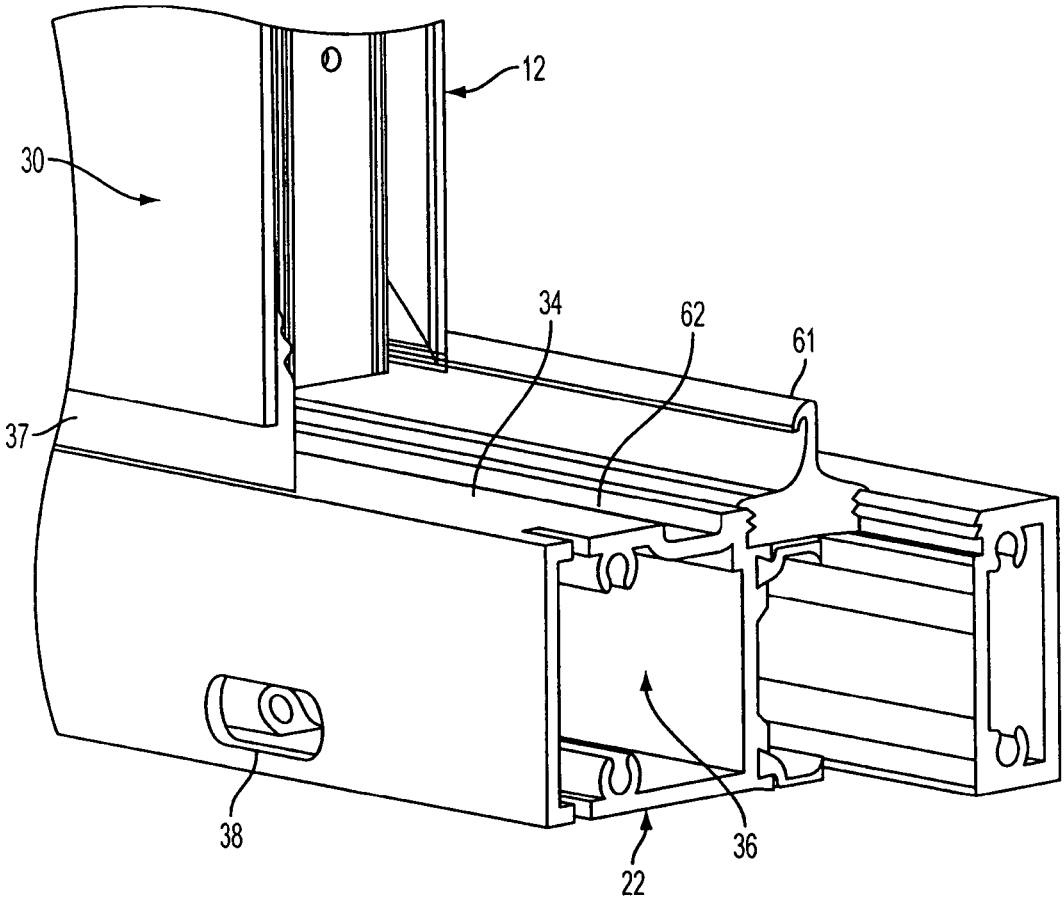
FIG. 7 illustrates a cross-sectional perspective view of the door-frame assembly of FIG. 4 with sections cut away for clarity.

Referring now to FIG. 7, a lengthwise cutaway of a door-frame sill 22 from one end, at a point where the external weep hole 38 is located, is shown. The interior cavity 36 of the door-frame sill 22 can be seen. The groove 62 running the length of the door-frame sill 22 can also be seen. The groove 62, along with the weep slot, helps remove water from the door assembly to the interior cavity 36. The external weep hole 38 then allows drainage of accumulated liquid from the interior cavity 36. The rubber seal 61, illustrated in this embodiment as including an upwardly extending generally J-shaped portion, is also shown. The rubber seal 61, sometimes called a gooseneck gasket, abuts the door sash 30 when the door sash 30 compresses the generally J-shaped portion into a closed (i.e., folded) position, thereby creating a compression-sealed barrier to the intrusion of both water and air into the interior of a building. The door-bottom gasket 37 is also shown.

In a typical embodiment, the rubber seal 61 as implemented in the door-sealing system performs two primary functions. First, the generally J-shaped portion extends upwardly and facing the door sash 30 so that, when the door sash 30 contacts the generally J-shaped portion and applies pressure thereto, the generally J-shaped portion of the rubber seal 61 folds and forms a compression seal against the door sash 30. In addition, when rolling pressure such as, for example, that applied by a wheelchair, is applied to the rubber seal 61, the rubber seal 61 deforms to permit the wheel to roll over the door-frame sill 22. Although the rubber seal 61 is described herein as being made of rubber, those having skill in the art will appreciate that any suitable material may be used without departing from principles of the invention.

It is believed that the operation and construction of the present invention will be apparent from the foregoing description. While various apparatus and methods shown or described above have been characterized as being applicable to channel water, various changes and modifications, including those related to channeling of other liquids, may be made therein without departing from the spirit and scope of the invention as defined in the following claims.

What is claimed is:

1. A system for impeding air or liquid penetration through an entry into an interior of a structure, the system comprising:

a door mounted to a door frame, the door frame comprising at least one first cavity formed therein;

a dual-sealing system between the door and the door frame, the dual-sealing system comprising an inner seal and an outer seal;

a second cavity defined by a region bounded by the inner seal, the outer seal, the door, and the door frame, the second cavity extending around a perimeter of the door;

a first weep hole formed in a vertical member of the door frame that permits liquid within the first cavity to flow into the second cavity only under the influence of gravity; and wherein a gap is formed in the outer seal that permits equalization of pressure of the second cavity with external atmospheric pressure.

2. The system of claim 1, comprising a second weep hole formed in a threshold member of the door frame that permits liquid within the second cavity to flow into the first cavity.

3. The system of claim 2, wherein the threshold member comprises a groove that channels liquid from the first weep hole to the second weep hole.

4. The system of claim 3, wherein the threshold member comprises an outer third weep hole that channels liquid to an exterior of the door frame, the outer third weep hole interoperably coupled to the second weep hole.

5. The system of claim 1, wherein the gap reduces deformation of a gasket forming at least part of the outer seal.

6. The system of claim 1, wherein the door comprises a durable and rust-resistant extrudable material.

7. The system of claim 1, wherein:

the inner seal comprises a gasket;

the gasket comprises a generally J-shaped member; and the generally J-shaped member forms at least one of a liquid-resistant and air-resistant seal responsive to a force applied against the gasket by the door.

8. The system of claim 7, wherein the gasket deforms responsive to being rolled over by a wheelchair.

9. The system of claim 1, comprising at least one unsealed hinge that channels liquid via the first cavity to the first weep hole.

10. The system of claim 1, wherein the door frame comprises a durable and rust-resistant extrudable material.

11. The system of claim 1, wherein the inner seal comprises:

a first gasket fixed along a length of an exterior side of a door-jamb stop portion of the door frame; and a second gasket extending upward from an upper surface of a threshold member of the door frame.

12. The system of claim 11, wherein:

the second gasket comprises a compressible gooseneck portion facing towards an exterior of the door.

13. The system of claim 2, wherein the threshold member comprises a groove spanning an upper surface of the threshold member and located outward of the inner seal.

14. The system of claim 13, wherein the second weep hole is formed in the groove, the second weep hole allowing liquid to drain into the first cavity.

15. The system of claim 1, wherein the outer seal comprises a sweep gasket.

16. A method of using the system for impeding infiltration of air or liquid through a structure entry or claim 1, the method comprising:

providing the door mounted to the door frame comprising the first cavity;

providing the inner seal and the outer seal;

wherein the second cavity is defined by a region bounded by the inner seal, the outer seal, the door, and the door frame;

equalizing the second-cavity pressure with the external atmospheric pressure via the gap formed in the outer seal; and draining liquid from the first cavity via the first weep hole formed in the door frame and interoperably coupled with the first cavity.

17. The method of claim 16, wherein the draining step comprises liquid flowing from the first cavity of the vertical member into the second cavity through the first weep hole formed in the vertical member of the door frame.

18. The method of claim 17, wherein the draining step comprises liquid flowing from the second cavity to into the first cavity of the threshold member of the door frame though a second weep hole formed in the threshold member.

19. The method of claim 18, wherein the draining step comprises channeling liquid from the first weep hole formed in the vertical member to the second weep hole formed in the threshold member via a gasket mounted to the threshold member of the door frame and forming at least part of the inner seal.

20. The method of claim 19, wherein the draining step comprises liquid flowing exterior to the structure entry via an outer third weep hole interoperably coupled to the weep hole formed in the threshold member.

21. The method of claim 16, wherein the equalizing step reduces deformation due to external air pressure of a gasket forming at least part of the outer seal.

22. The method of claim 16, wherein the inner seal comprises a gasket comprising a generally J-shaped member that forms a liquid-resistant and air-resistant compression seal responsive to an external force against the gasket by the door.

23. The method of claim 22, comprising the gasket deforming responsive to being rolled over by a wheelchair.

24. The method of claim 16, wherein the inner seal comprises a gasket fixed along a full length of an exterior side of a stop of the door frame and a gasket extending upward from an upper surface of a threshold member of the door frame.

25. The method of claim 16, wherein the inner seal comprises a compressible gooseneck gasket facing toward an exterior of the structure entry.

26. The method of claim 16, comprising a threshold member of the door frame, the threshold member having formed therein a groove spanning an upper surface of the threshold member and located outward of the inner seal.

* * * * *

UNITED STATES PATENT AND TRADEMARK OFFICE

CERTIFICATE OF CORRECTION

PATENT NO. : 8,276,320 B2
APPLICATION NO. : 12/181856
DATED : October 2, 2012
INVENTOR(S) : Kelly Erbrect et al.

It is certified that error appears in the above-identified patent and that said Letters Patent is hereby corrected as shown below:

Column 1, Line 53

Replace "Prior-alt door-frame"

With -- "Prior-art door frame" --

Column 3, Line 22

Replace "door-flame-mounted door"

With -- "door-frame-mounted door" --

Column 4, Line 18

Replace "vertical iamb member"

With -- "vertical jamb member" --

Column 4, Line 19

Replace "vertical iamb member"

With -- "vertical jamb member" --

Column 7, Line 50, Claim 16

Replace "a structure entry or claim 1,"

With -- "a structure entry of claim 1," --

Signed and Sealed this
Twenty-second Day of January, 2013

David J. Kappos

David J. Kappos
*Director of the United States Patent and Trademark Office*